US011571599B1

(12) United States Patent
Birgen

(10) Patent No.: US 11,571,599 B1
(45) **Date of Patent: *Feb. 7, 2023**

(54) VARIABLE TENSION/RESISTANCE PAYOUT CONTROL MACHINE

(71) Applicant: Kyllburg Technologies, LLC, Tempe, AZ (US)

(72) Inventor: William Birgen, Tempe, AZ (US)

(73) Assignee: Kyllburg Technologies, LLC, Tempe, AZ (US)

( * ) Notice: Subject to any disclaimer, the term of this patent is extended or adjusted under 35 U.S.C. 154(b) by 32 days.

This patent is subject to a terminal disclaimer.

(21) Appl. No.: 17/092,528

(22) Filed: Nov. 9, 2020

Related U.S. Application Data

(63) Continuation of application No. 16/032,279, filed on Jul. 11, 2018, now Pat. No. 10,828,524.
(Continued)

(51) Int. Cl.

| | |
|---|---|
| ***A63B 21/00*** | (2006.01) |
| ***A63B 69/00*** | (2006.01) |
| ***A63B 24/00*** | (2006.01) |
| ***A63B 21/005*** | (2006.01) |
| ***A63B 21/015*** | (2006.01) |

(52) U.S. Cl.
CPC .... *A63B 21/00076* (2013.01); *A63B 21/0058* (2013.01); *A63B 21/015* (2013.01); *A63B 21/153* (2013.01); *A63B 21/154* (2013.01); *A63B 21/4009* (2015.10); *A63B 24/0062* (2013.01); *A63B 24/0087* (2013.01); *A63B 69/0022* (2013.01); *A63B 69/0028* (2013.01); *A63B 2024/0093* (2013.01); *A63B 2220/40* (2013.01); *A63B 2220/833* (2013.01); *A63B 2220/836* (2013.01); *A63B 2225/52* (2013.01); *A63B 2244/18* (2013.01)

(58) Field of Classification Search
CPC ..... A63B 21/00076; A63B 24/0062; A63B 24/0087; A63B 21/4009; A63B 69/0028; A63B 21/015; A63B 21/0058; A63B 21/153; A63B 69/0022; A63B 21/154; A63B 2244/18; A63B 2220/833; A63B 2220/836; A63B 2024/0093; A63B 2220/40; A63B 2225/52; A63B 21/15–156; A63B 21/22–227; A63B 21/012–018; A63B 21/0056
See application file for complete search history.

(56) References Cited

U.S. PATENT DOCUMENTS 3,481,584 A 12/1969 Conry et al.
4,010,948 A 3/1977 Deluty
(Continued)

*Primary Examiner* — Andrew S Lo
(74) *Attorney, Agent, or Firm* — Venjuris, P.C.

(57) ABSTRACT

This invention is embodied by a controlled, variable tension line, payout reel machine. A system of sensors detect line tension and line distance paid out, location, and transmit through wired and unwired communication to a microprocessor. The microprocessor is co-located with the reel structure, which in turn applies, via a brake feature, resistance to the reel which is paying out the line being pulled by the user. This invention pertains to all applications where it is desirable to control the tension in a line paid out from a reel or reel. As stated, the payout motive force is supplied by the person, animal or apparatus attached to the end of the line, opposite the reel. The invention applies to the field of precise and measured control of line tension for sport, sport training, performance testing.

9 Claims, 7 Drawing Sheets

Related U.S. Application Data

(60) Provisional application No. 62/532,249, filed on Jul. 13, 2017.

(56) References Cited

U.S. PATENT DOCUMENTS

| | | | |
|---|---|---|---|
| 4,114,875 | A | 9/1978 | Deluty |
| 4,469,324 | A | 9/1984 | Dolan |
| 5,070,816 | A | 12/1991 | Wehrell |
| 5,476,428 | A | 12/1995 | Potash et al. |
| 6,790,163 | B1 | 9/2004 | Van De Laarschot et al. |
| 7,175,569 | B1 | 2/2007 | Lan et al. |
| 7,608,015 | B2 | 10/2009 | Radow |
| 8,167,620 | B1 | 5/2012 | Baker et al. |
| 10,124,206 | B2 | 11/2018 | Wehrell |
| 2004/0087418 | A1 | 5/2004 | Eldridge |
| 2011/0172058 | A1 | 7/2011 | Deaconu et al. |
| 2011/0251021 | A1 | 10/2011 | Zavadsky et al. |
| 2012/0053014 | A1 | 3/2012 | Zhu |
| 2013/0085046 | A1 | 4/2013 | Jolly |
| 2013/0337981 | A1 | 12/2013 | Habing |
| 2014/0323270 | A1 | 10/2014 | Lawrence |
| 2015/0126344 | A1 | 5/2015 | Wehrell |
| 2015/0165272 | A1 | 6/2015 | Bird |
| 2016/0101322 | A1 | 4/2016 | Potter et al. |
| 2016/0121156 | A1 | 5/2016 | Bach et al. |
| 2017/0333756 | A1 | 11/2017 | Bird |
| 2018/0001128 | A1 | 1/2018 | Norris |
| 2018/0214729 | A1 | 8/2018 | Rubin et al. |
| 2018/0214730 | A1 | 8/2018 | Larose et al. |
| 2018/0353813 | A9 | 12/2018 | Bird |
| 2019/0134448 | A1 | 5/2019 | Habing |
| 2019/0151716 | A1 | 5/2019 | Bird |

VARIABLE TENSION/RESISTANCE PAYOUT CONTROL MACHINE

PRIORITY CLAIM

The present application is a continuation which claims priority to co-pending United States non-provisional patent application entitled "Variable Tension/Resistance Payout Control Machine," having the application number of Ser. No. 16/032,279, filed on Jul. 11, 2018 and U.S. provisional application having Ser. No. 62/532,249, filed on Jul. 13, 2017, which is entirely incorporated herein by reference.

BACKGROUND

Many top performing athletes run with parachutes attached to themselves to provide a resistance force. Similarly, others run with ankle weights or weighted vests. Still, others employ a weighted sled attached via a harness to the body. None of these devices permit variable resistance, though. Treadmills offer variable resistance but they do not provide or allow for maneuvering while conducting open field running. None of these options, however permit the user to know the force he/she is training against. What is needed is a variable resistance training device that provides measured resistance forces.

SUMMARY OF INVENTION

The structure, overall operation and technical characteristics of the present invention will become apparent with the detailed description of preferred embodiments and the illustration of the related drawings as follows.

This invention is a variable, regulated line tension payout reel machine. Existing resistance trainers used by runners and ice skaters include parachutes and weighted sleds. These existing devices are crude and offer no dynamic or programmable or variable load. These resistance sleds and parachutes do not monitor or identify wasted lateral or vertical movements. Given the lateral and vertical sensing capacity of this invention, a user and his trainer can detect inefficient movements that do not contribute to forward speed. Furthermore, this invention offers precise control allowing it to be used by swimmers who require a very precise resistance load control when training. This invention is also suitable for equestrian training where variable, controlled load conditions would be advantageous. This invention also allows the resistance felt by the user to modulate. This modulation can simulate obstacles to be experienced by the user in competition, such as a tackle or a hurdle.

This Invention is Comprised of a Reel 14 which Imposes a Microprocessor Computer 28 Controlled Tension on a Payout Line 12 Attached to a User 18 or Paraglider Pilot Via a Harness or Belt 16. This Invention Also Features the Following Optional Elements:

- The resistive braking system may be an eddy current brake system which can be controlled to never lock up.
- An eddy current brake system also allows for exercising away from external power sources, relying on a rechargeable battery system.
- The precise load put on the payout line is controlled, measured and recorded.
- Ability to quickly & smoothly reduce tension in case of aborting a session,
- Brake pad material selected for ultra-smooth tows and low heat,

- Mount on the ground in a vehicle, on a trailer, in a boat or plug into a receiver hitch, and
- High speed rewind for quick set up for multiple payouts, maximizes repeated use.

Given the invention's embodiment for training runners or swimmers, a microprocessor computer controlled friction force is applied to the reel which pays out a line attached to a single runner or swimmer. Given the embodiment for training runners or swimmers, a microprocessor computer controlled friction force is applied to maintain a pre-programmed resistance force profile imposed on the runner or swimmer in response to tension measured in the line.

Embodiments which involve training require accurate measurement of the time at the start of use; the microprocessor will record movement of the sensors mounted on the harness worn by the user.

Given the embodiment for controlling the line payout via a microprocessor computer controlled friction force is applied to the reel paying out the line attached to the user's body harness or apparatus.

One embodiment the invention has a motor attached to the reel which pays out the line for the purpose of rapid retraction of the line for storage and repeated use.

DESCRIPTION OF THE EMBODIMENTS

Figure 1:
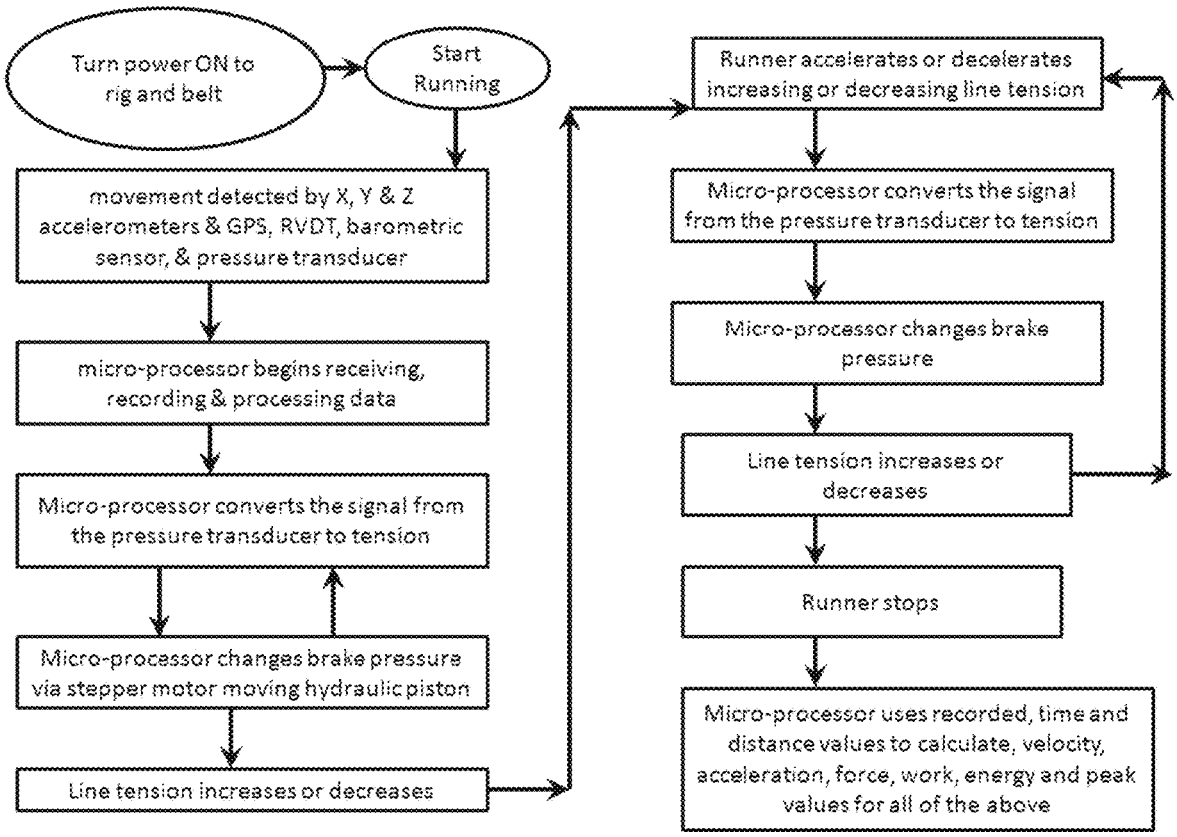
FIG. 1: Operational Block Diagram

The invention disclosed herein is the variable tension line payout control machine 10. It is a transportable reel based platform with a single flexible line 12 wound on its one reel 14. This line is attached to a belt or harness 16 worn by the user 18 and is paid out as the user moves away from the reel structure 44. The mode of force for paying out the line is provided by the user 18. When used as a source of resistance to runners and swimmers it is an invaluable piece of calibrated, precision controlled training equipment. Resistance is controlled, monitored, recorded and analyzed as the user run, swims or soars away. If the invention is mounted to a powered aircraft with a sailplane in tow, for example, it can control the tension in the line making towing of the sailplane safer for the towing aircraft and the sailplane alike. This regulated tension control system greatly increase safety when used in air-sports.

The drawings illustrate a typical structure supporting a reel, a reel with a revolution counting sensor and a friction system for managing the reel and line tension. Three pulleys serve to deliver and sense the line status. These three line pulleys are located between the reel and the user. The first pulley is closest to the reel and directs the line as it comes off the reel. The middle pulley is on a hydraulic or pneumatic cylinder with a pressure transducer which senses line tension via a change in pressure. (cylinder attached to middle pulley may be replaced by a load cell) The last pulley pivots freely on a rotary encoder. There is a compliment of sensors embedded in the harness attached to the end of the line paid out by the reel.

The distinguishable elements mounted on the reel structure include:

A pneumatic reservoir (or alternatively a hydraulic master cylinder) assembly with stepper motor (or equivalent) 34, 38, 40, 42;

A friction rotor and brake assembly 30, 32;

A reel 14;

A rotary encoder coupled to the reel 46;

Nylon rope, wire rope, Spectre® line, or some flexible line or wire or rope 12;

Three pulleys 26, 54, 60;

Rotary encoder on last pulley 52;

Pressure transducer at the tension measuring pulley 20;

Pneumatic piston acting on pressure transducer 24;

electrical power supply battery 82 is preferred embodiment;

reversing motor and simple switch 78, 80;

microprocessor 28;

wireless receiver, built into the microprocessor 66; and on/off switch 74.

The distinguishable elements mounted on the harness/belt include:

X, Y, Z accelerometers 68, 70, 72 respectively;

GPS 56;

Barometric sensor 76 (worn by user, located in harness belt);

Wireless transmitter 58 (worn by user, located in harness belt);

Line attachment carabineer or equivalent;

Belt/harness 16;

On/off switch 64 (worn by user, located in harness belt);

Battery 62 (worn by user, located in harness belt);

The operational flow diagram, FIG. 1, shows the order of process and how data is managed to control the line tension. The flow chart in FIG. 1 demonstrates how the sensors on the harness are being constantly transmitted to the microprocessor wirelessly at the same time wired data is being sent to the microprocessor from the rotary encoder on the pulley, pressure transducer and the rotary encoder on the reel.

The redundant sources of data will be averaged and compared against each other by the microprocessor to optimize accuracy, self-calibrate and to self-diagnose fault and maintenance.

There are three methods for detecting the distance traveled by the end of the line as it travels further from the reel. For convenience, let's call this the X direction where X=0 at time=0.

1. GPS "X" value,
2. "X" direction accelerometer, and
3. the rotary encoder on the reel; one revolution count=1 circumference of the reel paid out.

There are 3 methods for determining the side to side movement traveled by the end of the line. Let's refer to this as the +Y and —Y directions.

1. The GPS "Y" value,
2. The "Y" accelerometer, and
3. The optical encoder on the pulley.

There are 3 methods for determining the up and down movement occurring at the end of the payout line. Let's refer to this as the +Z value with Z=0 at time=0.

1. GPS "Z" value,
2. The "Z" accelerometer, and
3. The barometric sensor.

Figure 7:
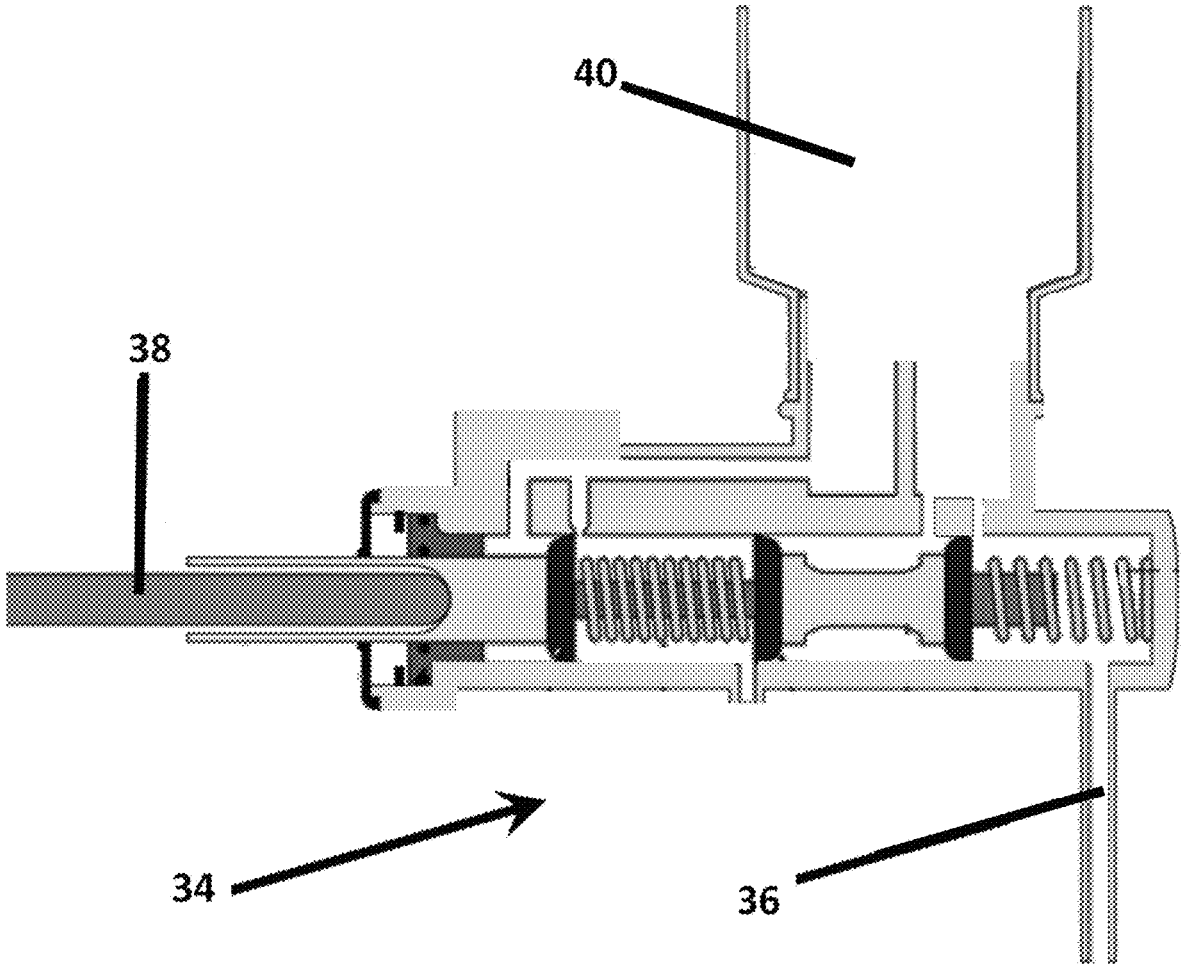
FIG. 7: Typical Master Cylinder Cross Section These figures reflect the preferred embodiment of this invention.

The master cylinder diagram shown in FIG. 7 illustrates the hydraulic means of applying frictional drag or braking force to the reel. The pushrod 38 shown is driven by a stepper motor 42, controlled by the microprocessor. The master cylinder may be comprised of single or multiple circuits, with each hydraulic circuit providing frictional drag to a dedicated rotor. If multiple rotors are desired, finer control of the applied friction is possible. While a hydraulic brake solution is available, pneumatic resistance system is equally feasible. The most preferred resistive force mechanism is an eddy current brake system.

The microprocessor provides the one source of time measuring against which all movements are measured, providing velocity, acceleration, work, energy and power. These values may be calculated for each direction allowing for values to be quantified for wasted directional movements, if desired. The rotors and reel are coaxial.

The cogged belt system shown is to illustrate the system for reeling in the line onto the reel after completing a payout cycle of the line. This motor is separate from the rest of the system and only serves to reduce cycle time between uses and time required to stow the invention after use.

A portable reel of Spectra® line 12, or some equivalent line, is allowed to payout under the power of the external force exerted on the payout line which is coupled to the user's harness via a carabineer or equivalent. The external force driving the payout is the user who is running, swimming, jumping etc. Equestrian training is yet another application, where the user is a horse.

The tension in the line is measured through a pressure sensor 20 attached to a hydraulic or pneumatic fluid body 22 (i.e. reservoir) being acted on by a piston 24 attached to the inventions middle pulley 26. A load cell is preferable to a hydraulic piston as it measures the tension directly. In the case of the pressure sensor 20 chosen for initial testing, it has a voltage output correlating to some tension scale. The embodiment demonstrated herein illustrates a hydraulic piston 24 being pulled away from the hydraulic fluid body as the tension in the line is increased. The pressure sensor 20 measures the change in hydraulic fluid pressure.

The pressure sensor's signal is sent via a wired connection to the microprocessor 28 where it is interpreted. In lieu of a pressure sensor 20 an alternate sensing method could be a load cell, a strain gauge or a tensiometer. In each case, the output load signal is sent via wired connection to the microprocessor 28.

The microprocessor modulates the pressure of disc brake pad/caliper assembly 30 on a rotor 32 coaxially located on the reel 14. By squeezing the rotor 32 with the brake pads/caliper assembly 30, tension in the line can be controlled. The brake system includes a master cylinder 34, connected to the brake calipers 30 by a hydraulic tube 36. (Items described as hydraulic tubes would be pneumatic tubes for a pneumatic resistive system.)

An alternate embodiment of this invention manages the tension so that the payout is at a constant rate. Of course if the pull on the line is too slow to meet the desired rate the most the invention can so is to reduce the line tension to zero. Recall, payout is driven by a source external to the invention, i.e. the user 18 an athlete, ice-skater, skier, horse, fish, etc.

As the line is paying out, the pressure sensor signal is received by the microprocessor 28 processed by the microprocessor, converting the pressure sensor signal to tension. The microprocessor 28 in turn moves the brake pads 30 acting on the rotor 32 by manipulating the pushrod 38 in the master cylinder 34 which acts on the hydraulic fluid in the master cylinder's 34 hydraulic reservoir 40. This is achieved by driving the pushrod 38 of the master cylinder 34 with a stepper motor 42. The microprocessor 28 moves the stepper motor 42 and monitors how far the pushrod 40 moves into the master cylinder 38 and hydraulic reservoir 40. By counting the "steps" of the square wave signals to the stepper motor 42 it is possible for the microprocessor to know the position of the pushrod 40 without a secondary monitoring method. An alternate embodiment could be a pneumatically driven braking/friction system acting on the rotor in lieu of hydraulics. Yet another embodiment is an (electronic) eddy current brake/resistance system. There is a constant process ongoing once the line begins to payout where the tension is sensed and frictional drag is increased or reduced on the reel to increase or decrease the line tension and subsequently the resistive force felt by the user 18.

The invention controls the pressure on the rotor 32 and subsequent drag force using appropriate brake pad 30 materials which allow for slipping. It is not desired to have so much friction as to stop the rotor completely. Stopping the rotor 32 completely during use would shock and otherwise jar the user. Correct selection of brake pad 30 and rotor 32 materials achieves this objective when used in conjunction with tuned and calibrated hydraulic (or pneumatic or eddy current) resistance.

The reel structure 44 includes a method for measuring the revolutions of the reel. By knowing the fractional and/or integer count of revolutions made by the reel 14, the microprocessor can determine how much line is paid out at any time. This is simple enough, by merely multiplying the circumference of the reel by the whole and fractional rotations made by the reel. The embodiment illustrated shows an optical encoder 46 coupled to the reel via a pulley and belt system 48. In this instance each full turn of the encoder 46 represents a fractional turn of the reel 14. The payout distance may be calculated by multiplying the circumference of the pulley 50 of the pulley and belt system 48, coaxially located at the optical encoder 46 multiplied by the revolutions of the optical encoder 46. An alternate embodiment has the encoder 46 coaxially mounted with the reel 14 axle. Such an embodiment would eliminate the pulley system 48 shown. Alternate embodiments use any number of revolution counting technologies, including a hall effects sensor, or proximity switch, or RVDT (rotary variable differential transformer) radial transducers, etc.

The preferred embodiment includes another radial optical encoder 52 for determining radial movement of the last pulley. 54 This optical encoder measures radial movement of the last pulley 54. The last pulley 54 is coupled to and swivels freely with the axis of this optical encoder 52. The radial movement of this encoder 52 is caused by the user's 18 lateral movement, left and right. The optical encoder's 52 angular signal is sent via a wired connection between the optical encoder 52 and the microprocessor 28. Upon receipt of the optical encoder 52 signal the microprocessor 28 converts the signal to an angular value. Using this angle, and the paid out distance value, and trigonometry, the microprocessor computes the left and right movement in distance. One possible calculation process to determine left and right movement would be to multiply the paid out length of the line by the Sine of the measured angle. The angle positive and negative distinction would occur about a zero angle occurring when the user is traveling directly normal, at zero degrees, from the payout control machine 10, causing absolutely zero angular deflection of the last pulley 54. The microprocessor 28 compares the GPS 56 values received via the wireless transmitter 58 against the measured lateral distance calculated. This comparison is used to self-calibrate the payout control machine 10 and to determine rates of data sampling as well as determining maintenance. Applications where side to side movement is not desired, these measured/calculated lateral+/−Y movements can be identified so that they can be eliminated through repeated use of the invention. An alternate embodiment to employing an optical encoder 52 about whose axis the last pulley 54 swivels would utilize any number of radial angle measuring technologies, such as a RVDT rotary variable differential transformer radial transducers, digital protractor, etc.

The redundancy in the sensing/detecting systems allows the system to self-diagnose and calibrate itself. Aside from the pressure sensor 20 measuring the tension and the optical encoder 46 measuring the revolutions of the reel 14, and another optical encoder 52 measuring lateral movement, the remaining collection of sensors is embedded in the harness or belt 16 worn by the user 18 and coupled to the payout line 12.

The sensors located in the harness/belt 16 worn by the user 18 communicate their data to the microprocessor 28 via wireless communication (telemetry). The precise protocol of this wireless communication is inconsequential to the nature of this patent. The preferred embodiment employs Zigbee wireless communication protocol, though WiFi, Bluetooth, AM, UHF, VHF, or RC could also work.

Reviewing the three pulley system that handles the payout line; this system of three pulleys handles the payout line 12. The first pulley 60 directs the line as it comes off the reel 14. The middle pulley 26 is connected to a hydraulic piston 24 acting on the pressure transducer 20 which senses line tension via a change in hydraulic pressure. The last pulley 54 pivots freely on an optical encoder 52. The hydraulic piston 24 and pressure transducer 20 could be replaced by a load cell.

Figure 2:
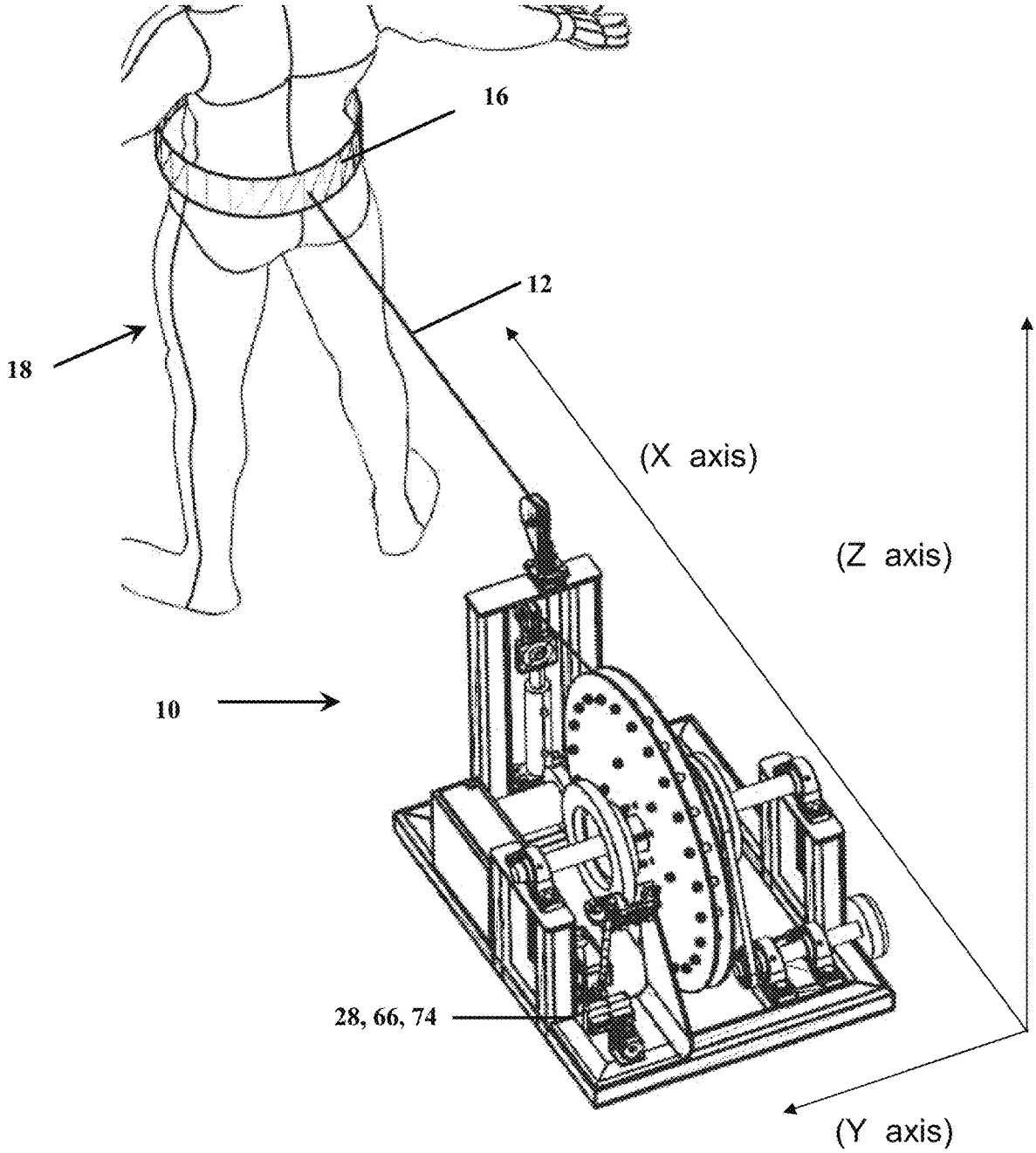
FIG. 2: Trimetric View, Left Aft Perspective
Figure 3:
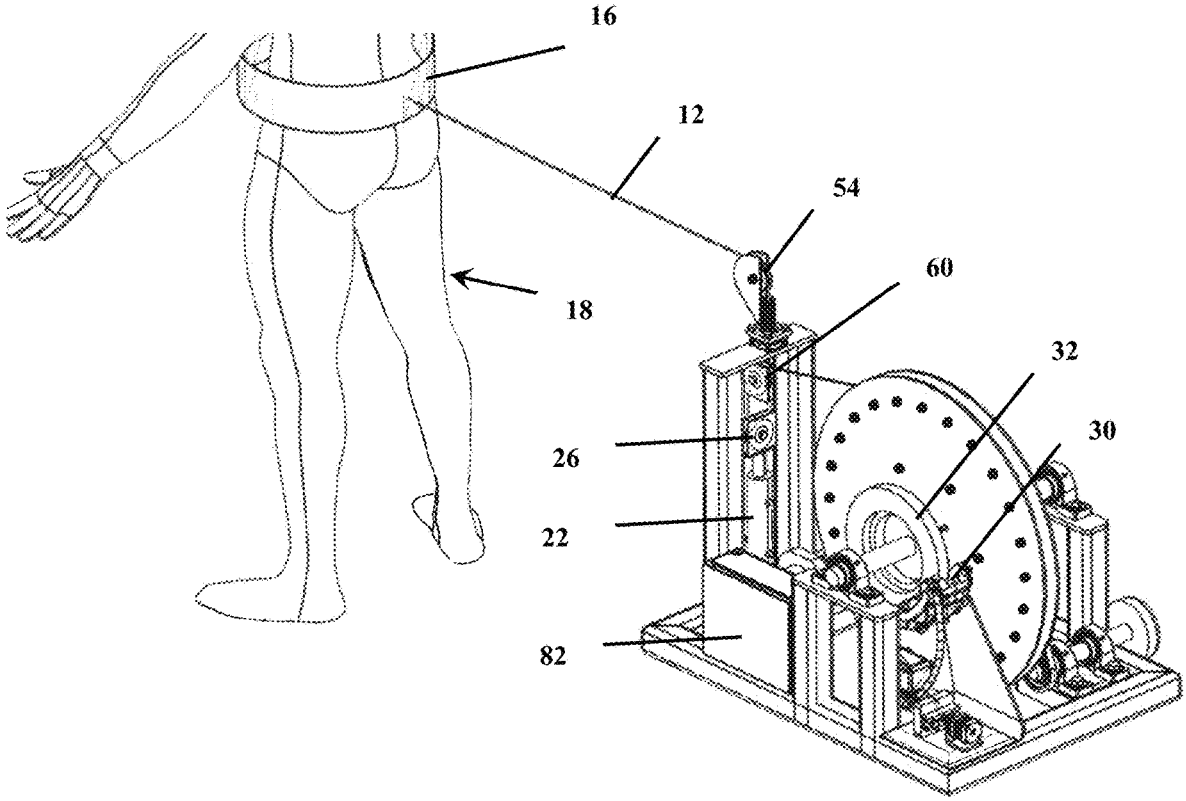
FIG. 3: Trimetric View, Left Perspective
Figure 4:
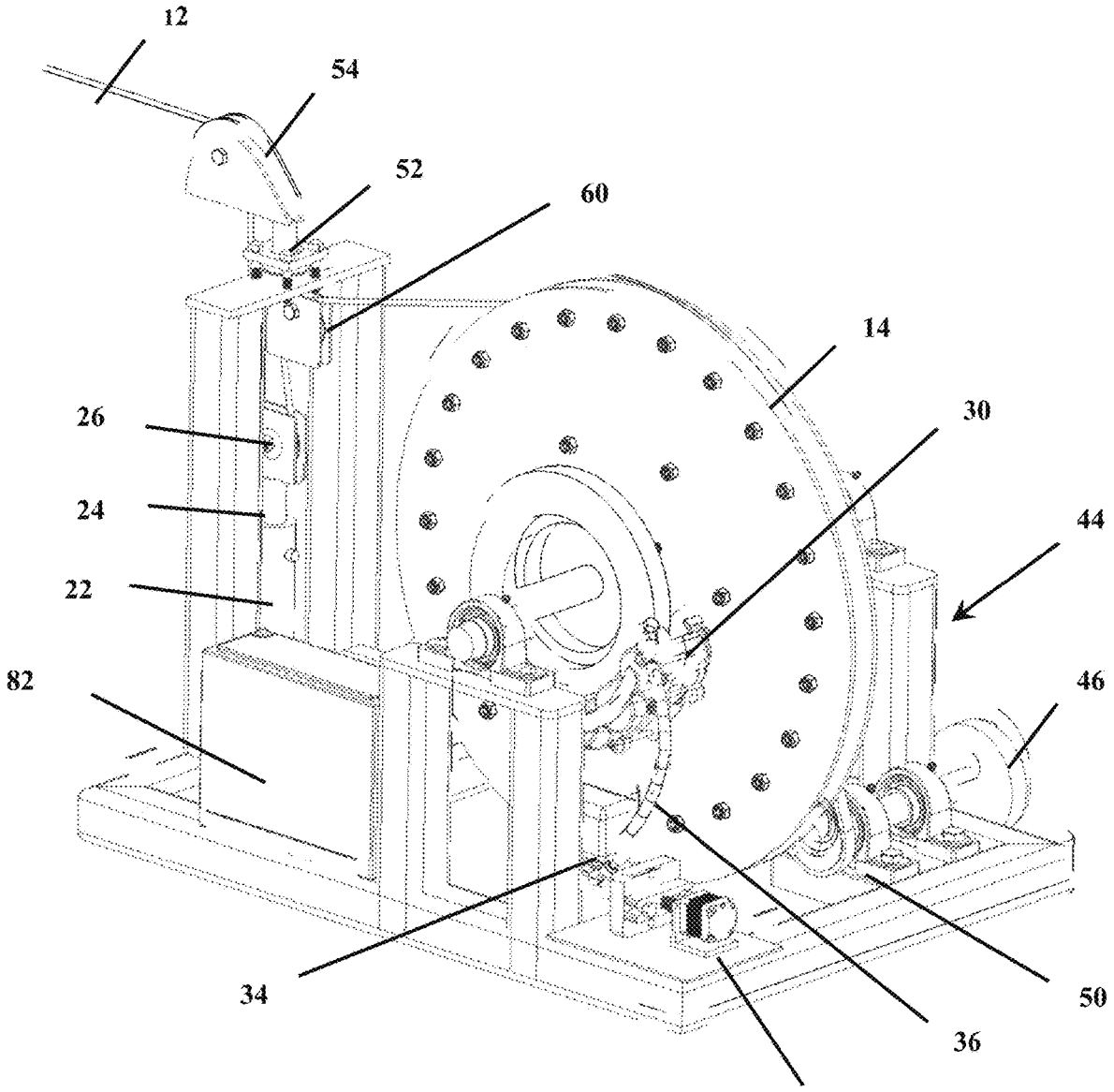
FIG. 4: Alternate Embodiment, 3 Pulleys on Common Center Line
Figure 5:
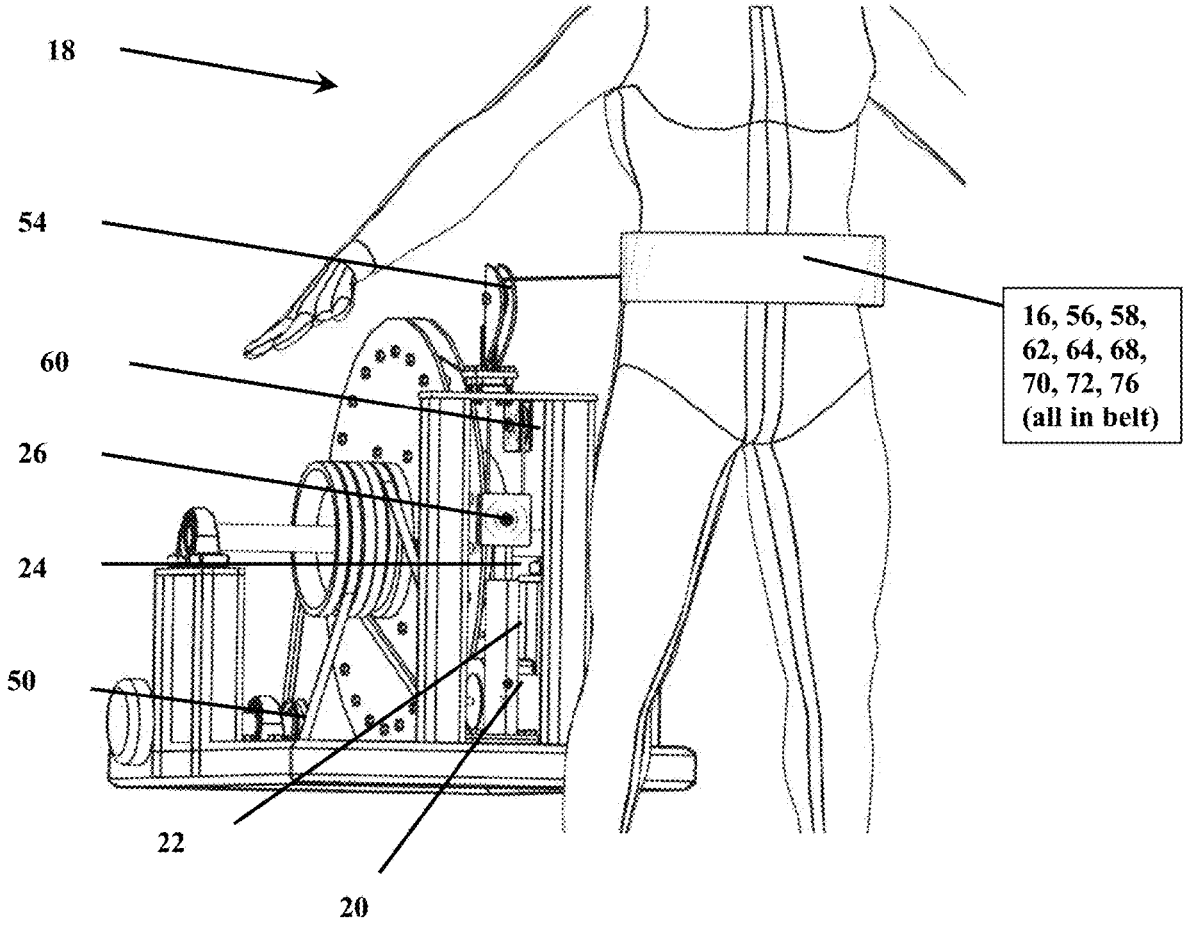
FIG. 5: Trimetric View, Forward Looking Aft
Figure 6:
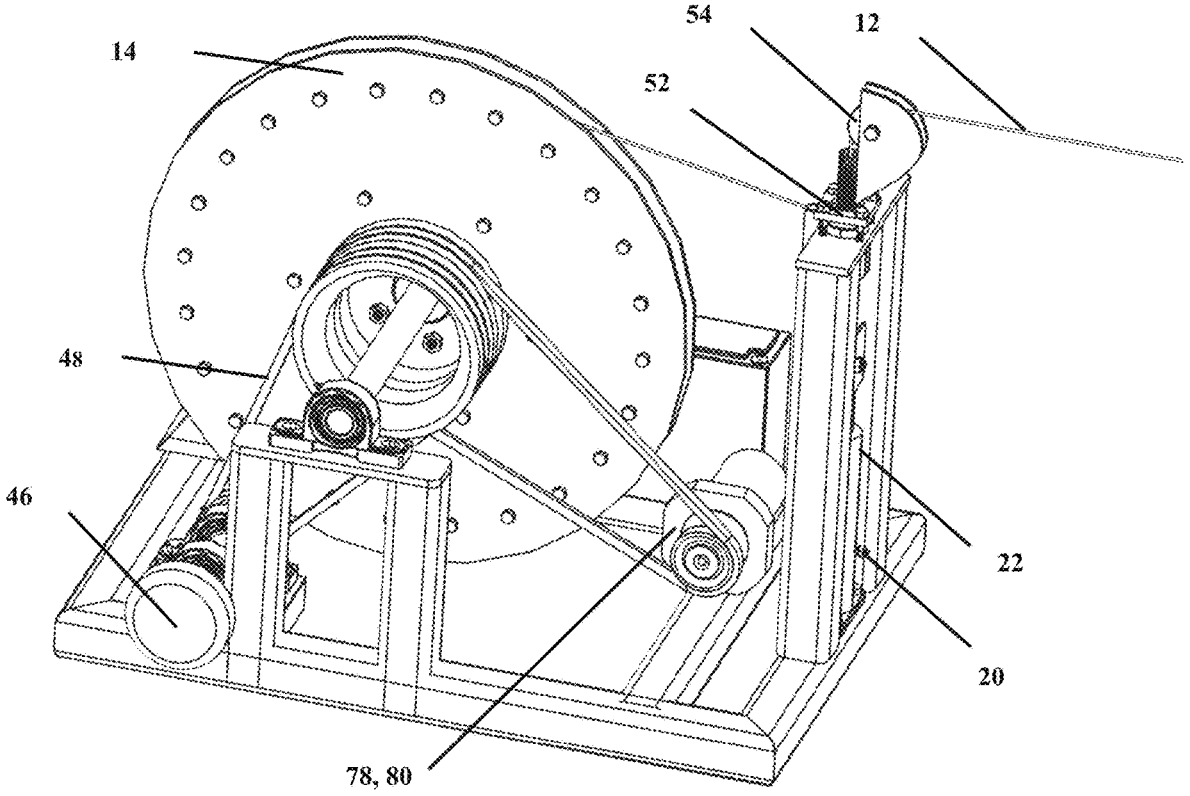
FIG. 6: Trimetric View, Right Perspective

The belt or harness 16 worn by the user 18 is coupled to the payout line via a carabineer or equivalent. The belt/harness 16 worn by the user contains one battery 62 and a single on/off switch 64 which powers/depowers the compliment of sensors and the transmitter in the belt/harness. The GPS device 56 in the belt receives a GPS signal from GPS satellites which includes positional information and a time value of the belt 16/user 18. The wireless data transmitter 58 in the belt/harness repeats the GPS data, sending it to the microprocessor's 28 built in receiver 66. The microprocessor will convert the GPS signal into X, Y and Z delta values where X is forward distance, Y is lateral side to side movement, and Z is an altitude, or vertical distance see FIG. 2. The time value of the GPS signal will be transmitted to the microprocessor 28 for calibration of the microprocessor's integral timing function.

Similar to the GPS device 56 in the transmitter 58, there are 3 discrete accelerometers an X direction accelerometer 68, a Y direction accelerometer 70, and a Z direction accelerometer 72, oriented orthogonally to each other. Each is oriented in the aforementioned X, Y, and Z directions. These accelerometers 68, 70, 72 send their signal data to the transmitter 58 which sends these accelerometer 68, 70, 72 signals to the microprocessor 28. The microprocessor 28 uses the data from the X, Y and Z accelerometers 68, 70, 72 to determine change in velocity. An accelerometer, by definition only detects changes in direction or velocity. This accelerometer 68, 70, 72 data will be processed by the microprocessor 28 and compared against the GPS 56 data and the angular encoder 46 calculated pay-out line length value to establish direction and speed of the user 18. The accelerometers 68, 70, 72 are also used to activate recording of each of the sessions where the apparatus is used. The reel structure 44 has two power on/off switches, the main power switch 74 connects the reel structure 44 battery 82 power to the microprocessor 28 and the rewind motor's 78 simple switch 80. These switches 64, 74 provide power to the invention before staring a session. Data recording begins in the microprocessor 28 when there is movement by the user 18 after the invention is powered. Recall there is one switch 64 on the belt/harness 64 as well.

Located in the belt/harness 16 is a barometric pressure sensor 76 which is a finely tuned altitude sensor. It detects how high off the ground the user 18 moves and this can be used in combination with the microprocessor's 28 timing feature to determine how quickly the user 18 rises and lowers during use. This is yet another source of sensing, and recording movement in the Z direction, using previously discussed X, Y & Z directions. The clock function in determining rate of rising and lower of the user 18 is provided by the microprocessor 28.

After a complete payout of the line 12 from the reel it is desirable to retract the line quickly so the variable tension line payout control machine 10 may be reused as soon as possible. In the preferred embodiment, a brushless DC electric motor 78 is couples to the reel 14 for this purpose. A simple switch 80 rewinds the reel, collecting the paid out line 12. When the line 12 is completely paid in the rewind motor 78 is powered off by a simple switch 80.

Even the most casual of readers will observe the detailed description herein follows the operational flow diagram of FIG. 1.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A variable resistance training device comprising, a reel assembly connected to a belt via a payout line, the reel assembly comprising a microprocessor, a reel rotatably connected to the reel assembly, the reel comprising a first rotary encoder, the first rotary encoder configured to transmit information to the microprocessor, a first pulley and a second pulley, the first pulley connected to a tension measuring device, the tension measuring device configured to transmit information to the microprocessor, a second rotary encoder for measuring rotational change of the second rotary pulley, the rotary encoder configured to transmit information to the microprocessor, the payout line connected to the reel on a first end and the belt on a second end, the payout line running through the first pulley and the second pulley, the tension measuring device configured to measure tension on payout line, the belt comprising an accelerometer, the accelerometer configured to transmit information to the microprocessor, and the microprocessor configured to receive information from the first rotary encoder, the microprocessor configured to receive information from the tension measuring device, the microprocessor configured to receive information from the second rotary encoder the microprocessor configured to receive information from the accelerometer.

2. The variable resistance device of claim 1, the belt further comprising a second and third accelerometers, the second and third accelerometers configured to transmit information to the microprocessor.

3. The variable resistance device of claim 2, wherein the first accelerometer is configured to detect movement in a first direction, the second accelerometer is configured to detect movement in a second direction, and the third accelerometer is configured to detect movement in a third direction.

4. The variable resistance device of claim 1, the belt further comprising a barometric sensor, the barometric sensor configured to transmit information to the microprocessor.

5. The variable resistance device of claim 1, the tension measuring device comprising a pressure sensor or a tensiometer.

6. The variable resistance device of claim 5, the tension measuring device coupled to a combination cylinder and piston rod, wherein the piston rod is connected to the second pulley and the pressure sensor measures the pressure change in the cylinder when the tension in the payout line changes.

7. The variable resistance device of claim 1, further comprising a stepper motor.

8. The variable resistance device of claim 7, the microprocessor tracking linear movement of a pushrod connected to the stepper motor.

9. The variable resistance device of claim 1, the belt further comprising a GPS device, the GPS device configured to detect movement of the belt.

* * * * *